US008183455B2

(12) United States Patent
Armstrong

(10) Patent No.: US 8,183,455 B2
(45) Date of Patent: May 22, 2012

(54) REMOVABLE INLINE SIGNAL INTERRUPTER FOR ELECTRIC GUITAR

(76) Inventor: Dennis Armstrong, Brick, NJ (US)

( * ) Notice: Subject to any disclaimer, the term of this patent is extended or adjusted under 35 U.S.C. 154(b) by 740 days.

(21) Appl. No.: 12/009,414

(22) Filed: Jan. 22, 2008

(65) Prior Publication Data

US 2008/0178727 A1 Jul. 31, 2008

(51) Int. Cl.
*G10H 1/46* (2006.01)
*G10H 3/12* (2006.01)

(52) U.S. Cl. ..... 84/741; 84/737; 84/740

(58) Field of Classification Search ..... None
See application file for complete search history.

(56) References Cited

U.S. PATENT DOCUMENTS

| | | | | |
|---|---|---|---|---|
| 4,532,847 | A * | 8/1985 | Youngblood | 84/741 |
| 4,944,016 | A * | 7/1990 | Christian | 381/74 |
| 5,010,802 | A * | 4/1991 | Lanham | 84/743 |
| 5,018,204 | A * | 5/1991 | Christian | 381/74 |
| 5,025,704 | A * | 6/1991 | Davis | 84/723 |
| 5,689,082 | A * | 11/1997 | Youngblood | 84/743 |
| 7,476,798 | B1 * | 1/2009 | Beller et al. | 84/743 |
| 7,785,133 | B2 * | 8/2010 | Wajcman | 439/412 |
| 7,818,078 | B2 * | 10/2010 | Iriarte | 700/94 |
| 7,947,892 | B2 * | 5/2011 | Crocker | 84/633 |
| 2001/0035084 | A1 * | 11/2001 | Kulas | 84/290 |
| 2002/0037669 | A1 * | 3/2002 | D'Addario | 439/669 |
| 2007/0003073 | A1 * | 1/2007 | Iriarte | 381/77 |
| 2008/0178727 | A1 * | 7/2008 | Armstrong | 84/741 |
| 2009/0181581 | A1 * | 7/2009 | Wajcman | 439/669 |
| 2009/0289635 | A1 * | 11/2009 | Coccio | 324/427 |
| 2010/0282046 | A1 * | 11/2010 | Crocker | 84/633 |
| 2011/0069849 | A1 * | 3/2011 | Borden | 381/120 |
| 2011/0209598 | A1 * | 9/2011 | Millar | 84/723 |

* cited by examiner

*Primary Examiner* — Marlon Fletcher
(74) *Attorney, Agent, or Firm* — Clifford G. Frayne

(57) ABSTRACT

A removable inline signal interrupter having a male/female combination plug, the male portion of the plug insertable into an electric guitar output receptacle, the female portion of the male/female plug having an internal negative-negative connection and an internal positive-positive connection, the positive-positive connection extending externally from the female portion of the male/female plug, and having an inline minimum volume dial and spring loaded on/off switch incorporated into the circuitry, the female portion of the male/female plug serving as a receptacle for the insertion of a male plug from the amplifier, the spring-loaded on/off lever switch allowing the guitarist to selectively interrupt the signal from the guitar to the amplifier.

6 Claims, 6 Drawing Sheets

REMOVABLE INLINE SIGNAL INTERRUPTER FOR ELECTRIC GUITAR

BACKGROUND OF THE INVENTION

1. Field of the Invention

The present invention relates to sound modifications for electric guitars, and more particularly, to a removable inline signal interrupter, which allows the user to effectuate special effects while playing the guitar.

2. Description of the Prior Art

Electric guitars are very popular and a variety of electric apparatus have been developed which allow for the sound modification of electric guitars. This allows musicians to create sounds that were previously obtainable only in recording studios or through the use of very expensive sound equipment. Examples of these electronic apparatus can be found in U.S. Pat. No. 5,105,711; U.S. Pat. No. 4,516,462; U.S. Pat. No. 4,484,508; and U.S. Pat. No. 4,481,854. All of the aforesaid patents disclose an electronic add-on feature which provides for special effects and sound modification when playing the electric guitar.

Applicant's invention relates to a removable inline signal interrupter having a minimum volume control which is adaptable to any electric guitar and allows the user/player to selectively interrupt the signal from the guitar to the amplifier.

Signal interruption as a special effect in playing the guitar is an effect that has been around for some time and has been utilized by many great guitar artists. However, the effect could only be achieved on a specific guitar which had undergone electronic manufacturing modification at the factory so as to allow the player/user to selectively interrupt the signal utilizing a factory installed switch peculiar to that particular guitar.

The removable inline signal interrupter with minimum volume control of the present invention is adaptable to any electric guitar.

OBJECTS OF THE INVENTION

An object of the present invention is to provide for a novel electrical apparatus which allows a guitar artist to selectively provide special sound effects from his guitar.

A still further object of the present invention is to provide for a novel electrical apparatus which serves as a removable inline signal interrupter which allows the guitarist to selectively interrupt the signal generated by the guitar when played.

A still further object of the present invention is to provide for a novel removable inline signal interrupter which is adaptable to any guitar.

A still further object of the present invention is to provide for a novel removable inline signal interrupter for the performing of special sound effects from a guitar, which novel removable inline signal interrupter can easily be mounted on any guitar.

SUMMARY OF THE INVENTION

A removable inline signal interrupter having a male/female combination plug, the male portion of the plug insertable into an electric guitar output receptacle, the female portion of the male/female plug having an internal negative-negative connection and an internal positive-positive connection, the positive-positive connection extending externally from the female portion of the male/female plug, and having an inline minimum volume dial and spring loaded on/off switch incorporated into the circuitry, the female portion of the male/female plug serving as a receptacle for the insertion of a male plug from the amplifier, the spring-loaded on/off lever switch allowing the guitarist to selectively interrupt the signal from the guitar to the amplifier.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
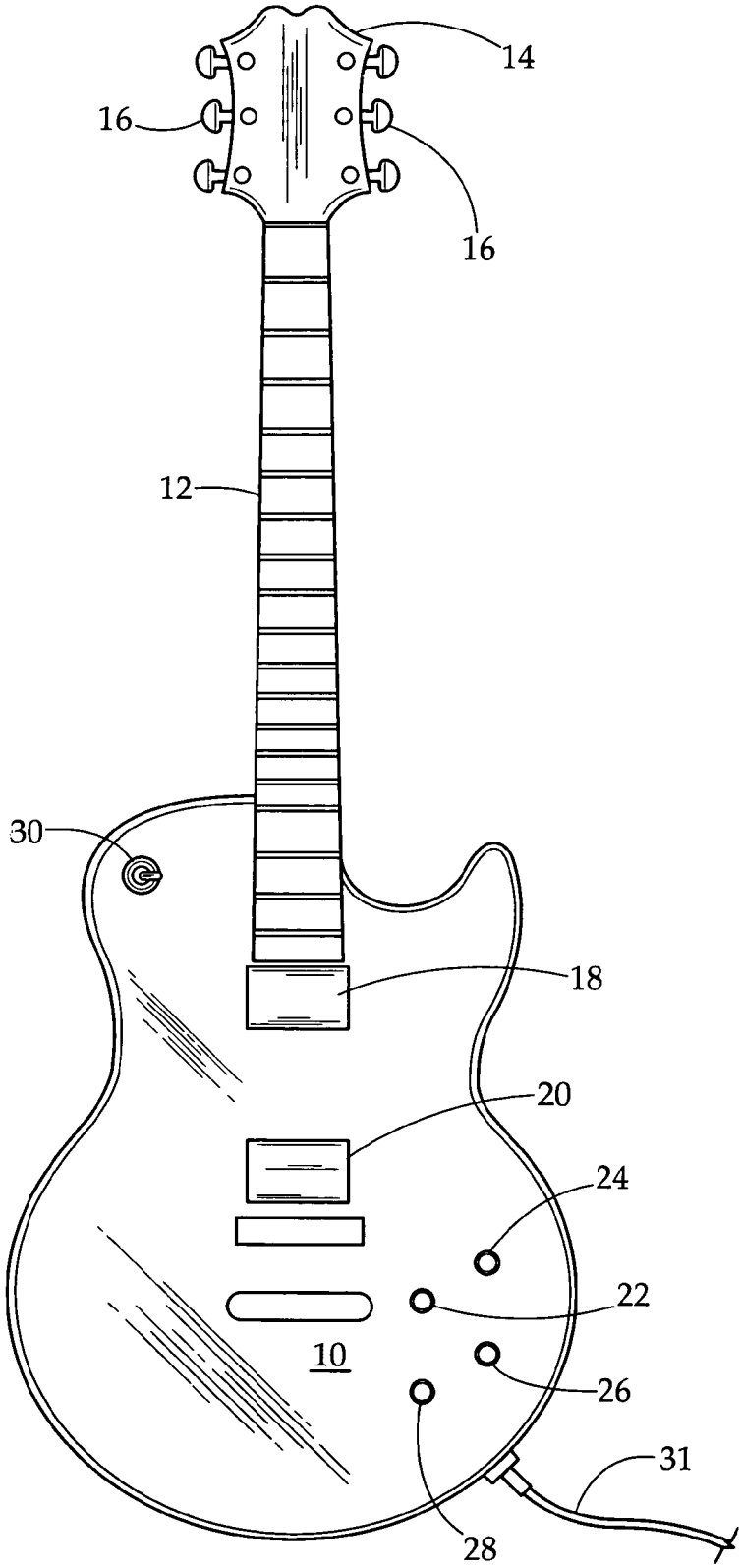
FIG. 1 PRIOR ART
FIG. 1 is a planar front illustration of a guitar of the prior art, which is internally wired to allow for signal interruption.

FIG. 1 is a front planar view of a guitar of the prior art which is capable of providing signal interruption in that it is hard wired to perform this acoustic effect in the manufacturing process. The guitar depicted in FIG. 1 comprises a body 10 with attached neck 12 with a head stock 14. The guitar strings or wires are stretched between the body 10 and the head stock 14 where adjustable tensioners 16 are positioned. This particular style of guitar has two pick up points, a rhythm or neck pick up 18 and a bridge or lead pick up 20. The rhythm or neck pick up 18 has its own volume control 22 and its own tone control 24 and the bridge or lead pick up 20 has its own tone control 26 and volume control 28.

Figure 2:
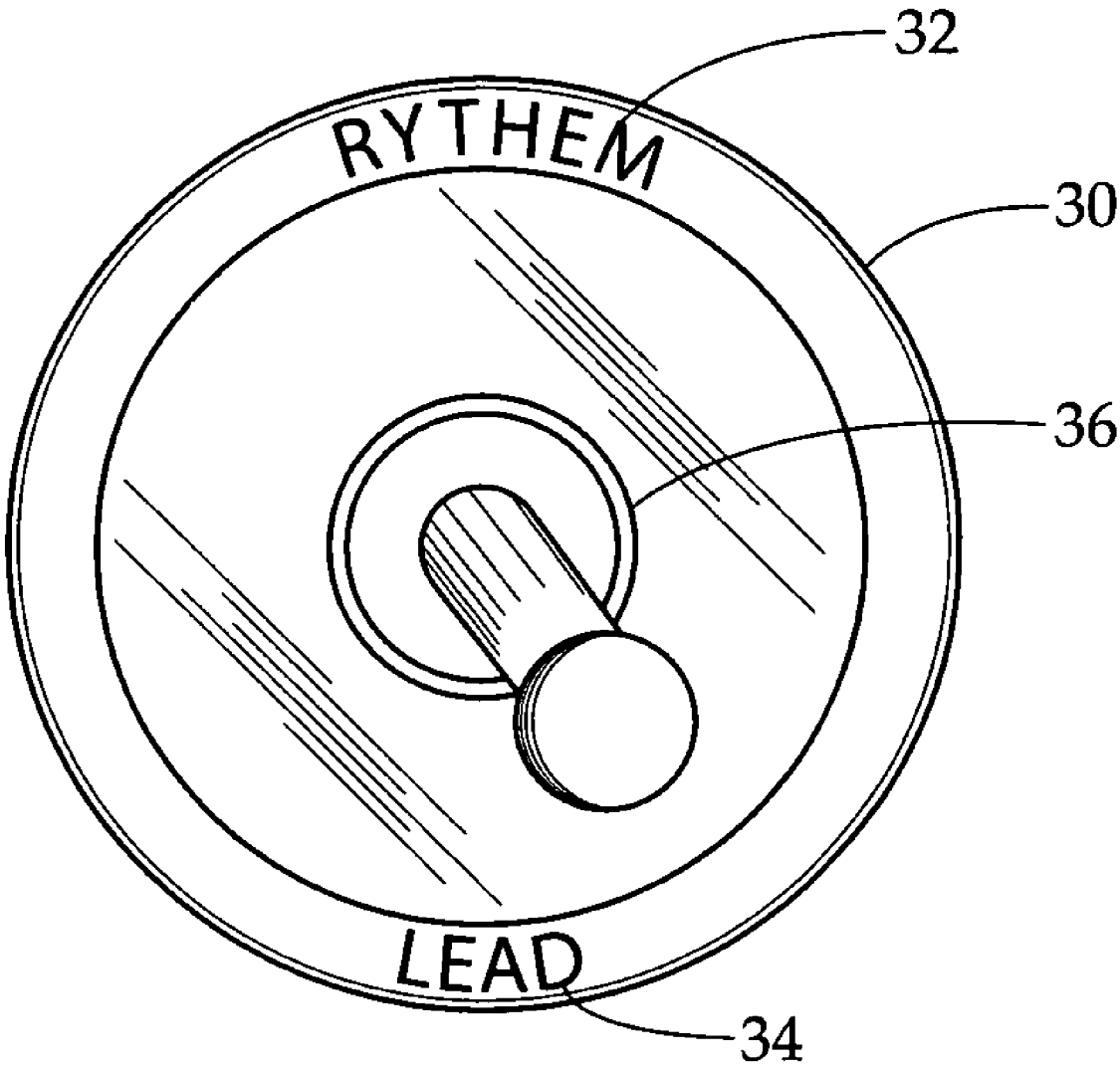
FIG. 2 PRIOR ART
FIG. 2 is a close up view of the control for allowing the interruption of the signal from the guitar illustrated in FIG. 1.

This particular type of guitar also contains a selector switch 30 shown in close up on FIG. 2. Selector switch 30 has three positions. When the switch is in the up or rhythm position 32, only the rhythm or neck pick up 18 signal will be heard through the guitar amplifier. Similarly, when the switch 30 is in the down or lead position 34, only the bridge/lead pick up signal 20 will be transmitted to and heard from the amplifier. When the switch 30 is in the center position 36, both the rhythm/neck pick up 18 and the bridge/lead pick up 20 will be heard through the amplifier. In this particular style of guitar, the amplifier connection 31 is on the underside of the guitar.

To obtain the effect sought by Applicant with his invention, the guitar of FIG. 1 would be operated in the following manner. To obtain the effect using the bridge or lead pick up 20, the volume control 22 for the rhythm pick up 18 would be turned to zero and the selector switch 30 would be in the down or lead position 34 and the volume control 28 for lead pick up 20 would be turned up. The guitarist would then commence a solo. At the appropriate time the guitarist would hold a note or chord and let it sustain or feed back, and then while using his strumming hand he would take and operate the selector switch 30 up and down creating an on and off effect for the sustaining or feedback note which he has selected. This provides the desired interruption sought by Applicant.

As previously stated, a guitar of the type depicted in FIGS. 1 and 2 with the selector switch 30 has different wiring in the manufacturing process in order to achieve the desired sound effect.

Figure 3:
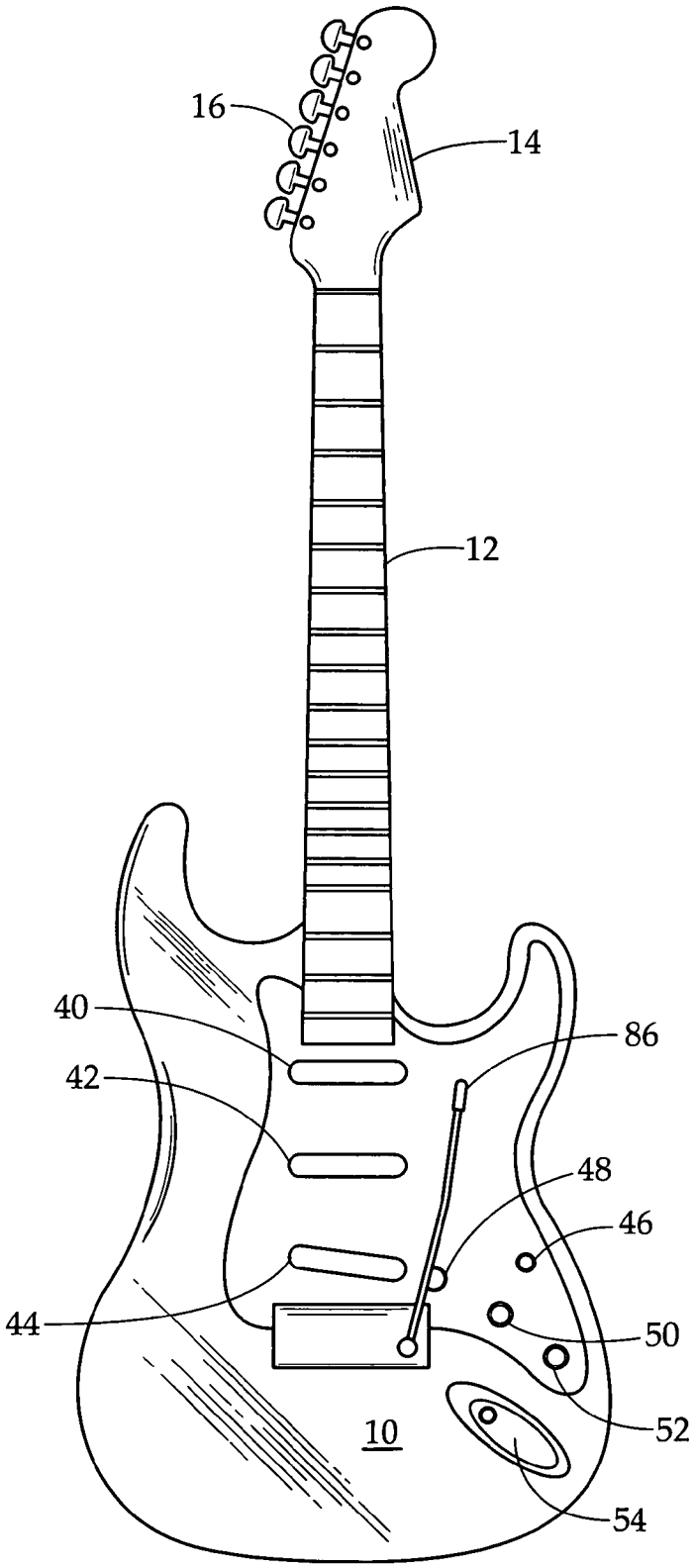
FIG. 3 PRIOR ART
FIG. 3 is a planar view of a standardized electric guitar which is not internally wired for signal interruption.

FIG. 3 is an illustration of an electric guitar more commonly found in use by guitarists. It is similar in design to the guitar depicted in FIG. 1 in that it consists of a body 10, neck 12, head stock 14, tensioners 16 and a plurality of guitar strings or wires extending along the neck from the body of the guitar. The guitar of FIG. 3 contains three pickups 40, 42, and 44, with a selector switch 46, volume dial 48, tone dials 50 and 52, and a signal output receptacle 54 into which the electrical conduit from the amplifier is plugged in. There is no selector switch 30 or equivalent thereof on the guitar as depicted in FIG. 3. Therefore the guitar as depicted in FIG. 3 is incapable of performing the on/off effect of the sustaining or feedback notes selected by the guitarist as described in relationship to the guitar of FIG. 1. The selector switch 46 found on the guitar depicted in FIG. 3 allows the guitarist to control which pickups or combination of pickups, 40, 42, and 44, will be transmitted to the amplifier. This selector switch does not function or perform the effect of the selector switch 30 found on the guitar depicted in FIG. 1 so that the guitar depicted in FIG. 3 with only one volume dial is incapable of providing signal interruption to the guitarist.

Applicant's removable inline signal interrupter allows for a guitarist to obtain that effect with the guitar of FIG. 3.

Figure 4:
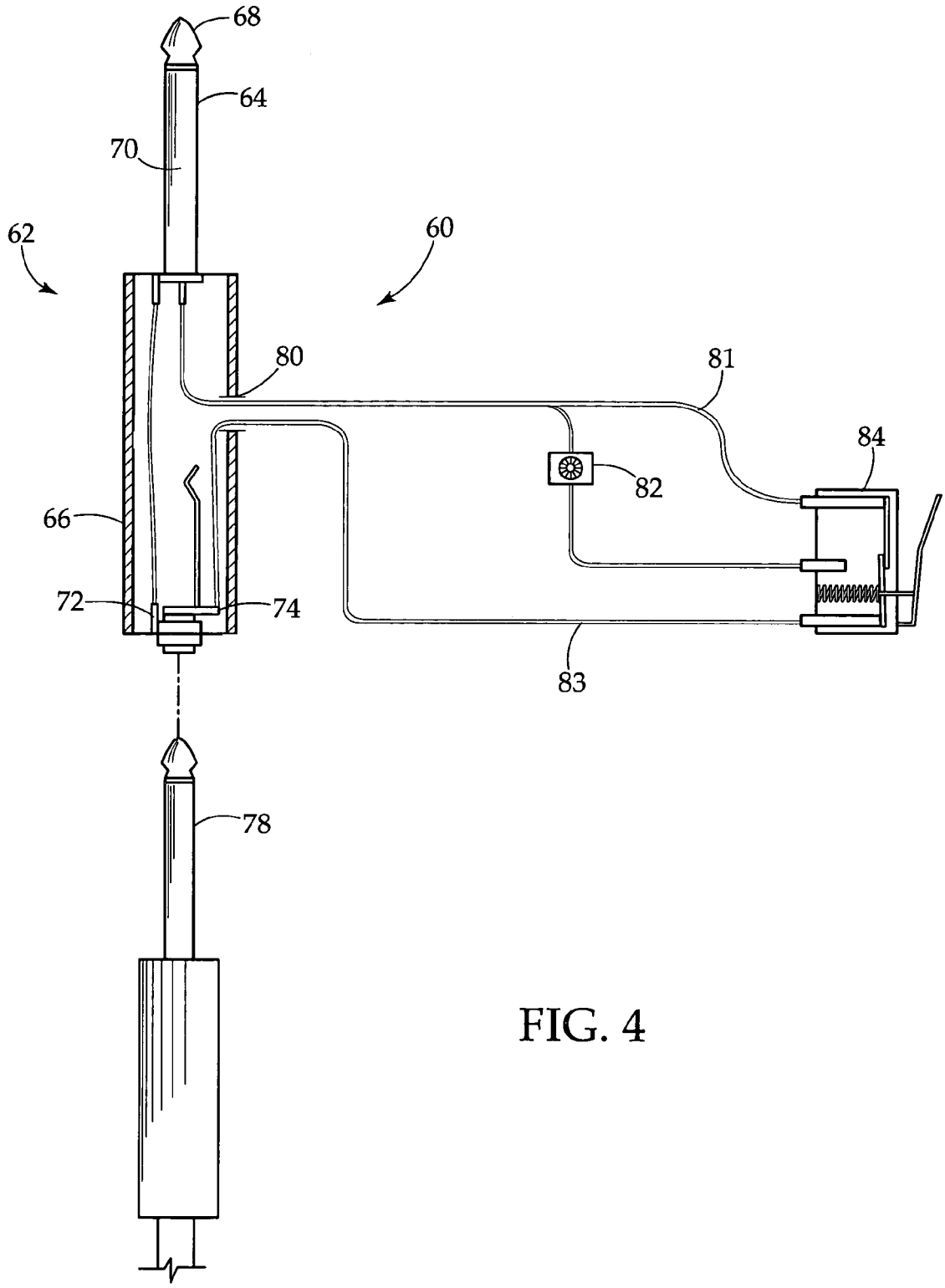
FIG. 4 is an exploded view of the signal interrupter of the present invention in an inactivated position.

FIG. 4 is an exploded diagram of Applicant's removable inline signal interrupter 60. Signal interrupter 60 is a male/female combination plug 62 having an extended male tip 64 and female plug housing 66. The tip 68 of the male portion 64 of the combination male/female plug 62 is a positive contact while the outer circumferential ring 70 of the male tip 64 is a negative contact. Within the female plug housing 66, the negative contact 70 is in communication with a negative contact connector 72 at the bottom of female plug housing 66 and the positive connection 68 is in contact with a positive connector 74 at the bottom of female plug housing 66. The female plug housing 66 is designed for receipt of the male plug 78 from the amplifier. The combination male/female plug 62 would be inserted into the signal output 54 on the guitar depicted in FIG. 3. The male amplifier plug 78 would then be inserted into the female plug housing 66 of male/female combination plug 62. The modification to female plug housing 66 is that the path of the positive connection within the female plug housing 66 is connected exteriorly through an aperture 80 in the female plug housing 66 to an inline minimum volume control 82 and a spring loaded lever control switch 84. These devices are then mounted on the body 10 of the guitar depicted in FIG. 3 in a convenient location, preferably on the tremolo bar 86 for ease of access by the guitarist.

In FIG. 4, the spring loaded lever control switch is not activated and thus the signal from the guitar passes through the spring loaded lever control switch 84 by means of conduit 81 and 83 with the inline minimum volume control 82 playing no role, or affecting the signal.

Figure 5:
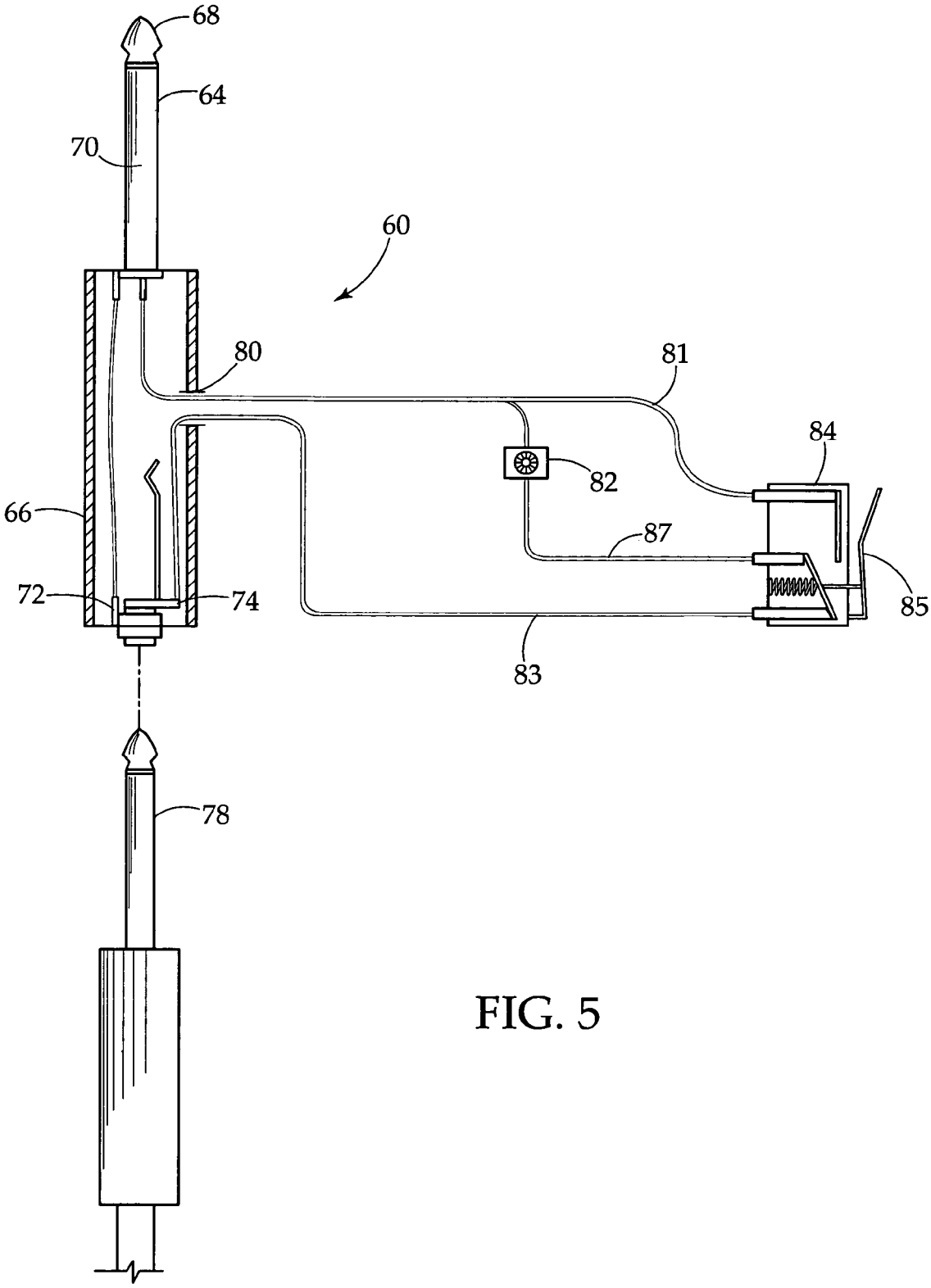
FIG. 5 is a planar view of the signal interrupter in an activated position.

FIG. 5 illustrates the removable inline signal interrupter 60 in an activated position. All of the elements are identical except that the spring loaded lever control switch 84 is activated in that its control arm 85 has been depressed, breaking contact with conduit 81, and making contact with conduit 87. The inline minimum volume control 82 now plays a role and can affect the signal since the signal is now proceeding to the amplifier via the inline minimum volume control 82, conduit 87, and conduit 83. In essence, we have provided a guitar with a single volume control with an additional volume control.

In operation the guitarist adjusts the inline volume control dial 82 to a desired setting, and when the guitarist desires to use the on and off effect of the sustaining or feedback note selected, the guitarist utilizes a finger to depress the spring loaded switch 84 which breaks the connection between the guitar and the amplifier. Release of the switch closes the circuit and the desired sounds from the guitar are transported to the amplifier.

Figure 6:
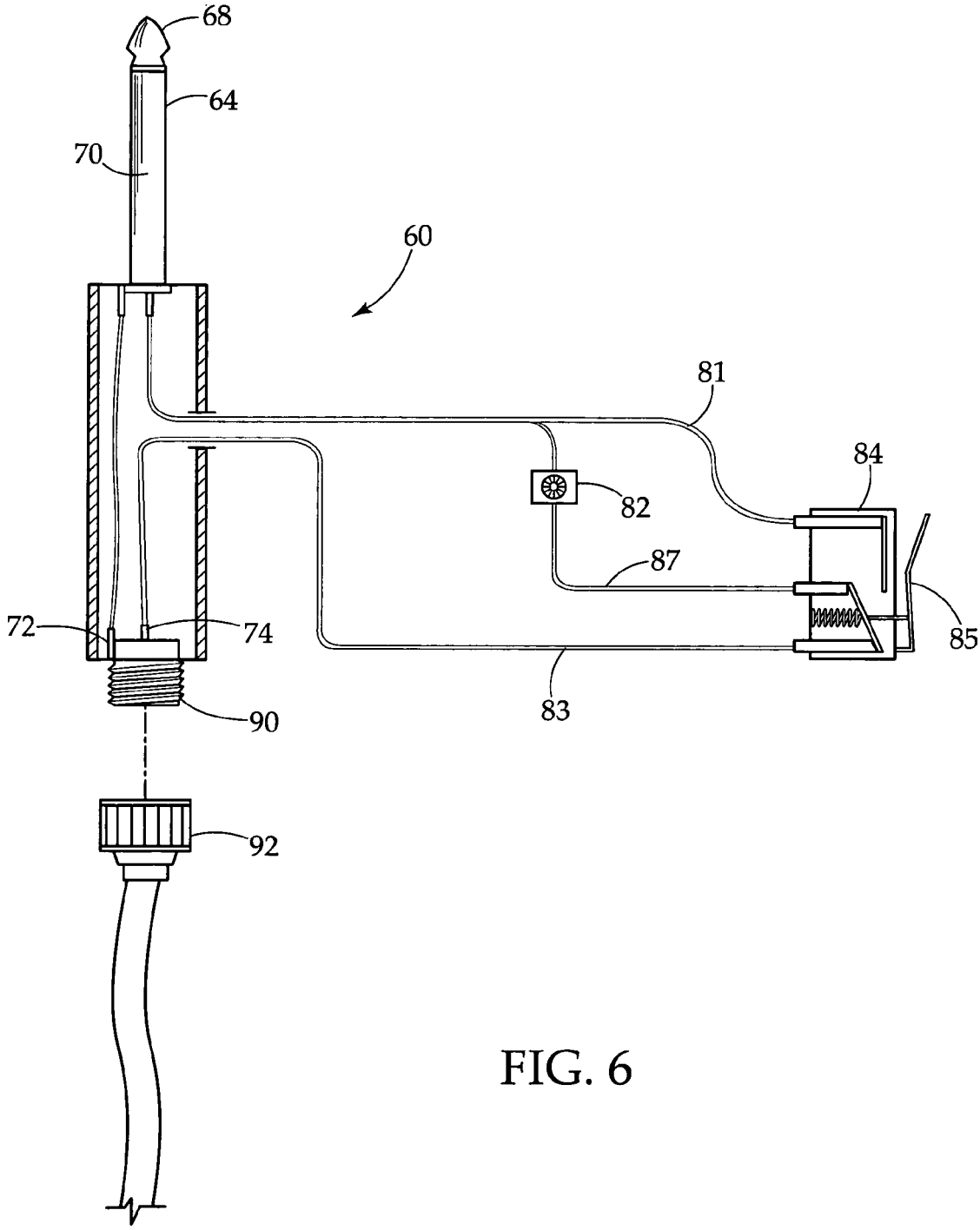
FIG. 6 is a planar view of the signal interrupter of the present invention illustrating a second embodiment of a connection to an amplifier.

FIG. 6 is an exploded diagrammatic view of a second embodiment of Applicant's removable inline signal interrupter 60. The signal interrupter 60 wiring diagram remains the same and is unchanged. The second embodiment illustrated in FIG. 6 avoids the encumbrance of having a female plug housing 66 extending from the body 10 of the guitar, and having an additional male plug 78 in communication with the amplifier further extending from the female plug housing 66. In the embodiment illustrated in FIG. 6, the male/female combination plug 62 is considerably shortened and the female receptacle eliminated. The former female housing end 66 of the male/female combination plug 62 is replaced with a threaded connector 90 which would be cooperable with a threaded connector 92 on the conduit in connection with the amplifier. This arrangement considerably shortens the male/female combination plug 62 and eliminates the additional male plug 78 which would have been inserted into the female plus housing 66 and it would have caused a further extension of the female plug housing 66. The connection with the inline minimum volume control 82 and spring loaded lever control switch 84 and their operation remains the same as described with respect to FIG. 5.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A removable inline signal strength interrupter for an electric guitar for achieving an on-off-on-off signal volume effect or a vibrato effect, said electric guitar having a guitar volume control controlling signal strength to an output socket for communication with an amplifier, said removable inline signal interrupter comprising:

a removable inline signal strength interrupter jack member secured to said output socket of said electric guitar and interposed between said jack member and said amplifier;

circuitry for connecting said inline strength interrupter jack member with a signal strength interrupter switch and circuitry for interposing a signal strength interruption volume control between said signal strength interrupter switch and said inline signal strength interrupter jack, said signal strength interrupter volume control set independently of said guitar volume control, manual activation of said signal strength interrupter switch temporarily placing signal strength control with said signal strength interrupter volume control;

a receptacle for receipt of an amplifier jack; and mounting means for mounting said signal strength interrupter switch and said signal strength interrupter volume control to said guitar.

2. The removable inline signal strength interrupter in accordance with claim 1 wherein said removable inline signal interrupter jack is removably insertably connectable to any electric guitar.

3. The removable inline signal strength interrupter in accordance with claim 1 wherein said interrupter switch is biased and manually activatable.

4. The removable inline signal strength interrupter in accordance with claim 1 wherein said volume control is manually adjustable.

5. The removable inline signal strength interrupter in accordance with claim 1 wherein said removable inline signal interrupter jack is formed with a jack receptacle for receipt of said amplifier jack.

6. The removable inline signal strength interrupter in accordance with claim 1 wherein said removable inline signal interrupter jack is formed with a threaded male/female connection for threadedly securing a male/female connection from said amplifier.

* * * * *